US005520830A

United States Patent [19]

Klaus et al.

[11] Patent Number: 5,520,830

[45] Date of Patent: May 28, 1996

[54] COMPOSITION AND PROCESS FOR RETARDING LUBRICANT OXIDATION USING COPPER ADDITIVE

[75] Inventors: Elmer E. Klaus; John L. Duda, both of State College, Pa.

[73] Assignees: Akzo Nobel N.V., Arnhem, Netherlands; The Pennsylvania State Univ., University Park, Pa.

[21] Appl. No.: 400,434

[22] Filed: Mar. 6, 1995

Related U.S. Application Data

[63] Continuation of Ser. No. 776,524, Oct. 11, 1991, abandoned.

[51] Int. Cl.[6] ..... C10M 125/04; C10M 129/26

[52] U.S. Cl. ..... 252/49.7; 252/33.6; 252/35

[58] Field of Search ..... 252/49.7, 515 A

[56] References Cited

U.S. PATENT DOCUMENTS

| | | | |
|---|---|---|---|
| 2,552,570 | 5/1951 | McNab et al. | 252/32.7 |
| 3,346,493 | 10/1967 | LeSuer | 252/32.5 |
| 4,552,677 | 11/1985 | Hopkins | 252/33.6 |
| 4,867,890 | 9/1989 | Colclough et al. | 252/32.7 E |
| 4,915,857 | 4/1990 | Emert et al. | 252/51.5 A |
| 5,049,290 | 9/1991 | Emert et al. | 252/51.5 A |

*Primary Examiner*—Ellen M. McAvoy

*Attorney, Agent, or Firm*—Richard P. Fennelly; Louis A. Morris

[57] ABSTRACT

Deposit formation can be reduced and primary oxidation of the lubricant can be retarded in a lubricant when used in an internal combustion engine by incorporation of soluble copper (e.g., 1,500 to 3,000 ppm) in the lubricant.

5 Claims, No Drawings

COMPOSITION AND PROCESS FOR RETARDING LUBRICANT OXIDATION USING COPPER ADDITIVE

This is a continuation of application Ser. No. 07/776,524 filed Oct. 11, 1991, now abandoned.

BACKGROUND OF THE INVENTION

Lubricant compositions for internal combustion engines undergo oxidation with usage leading to undesired viscosity increase in the lubricant over time with the ultimate formation of high molecular weight products which produce undesired deposits in and adjacent to the combustion environment in the engine.

One recent patent which discusses the use of copper as an antioxidant for lubricating oil compositions is U.S. Pat. No. 4,867,890 to T. Colclough et al. in which from about 5 to about 500 parts per million of copper, more preferably 10–200 ppm, and most preferably 60–200 ppm, is advocated. This patent indicates that its copper antioxidant is "effective at low concentrations" (Col. 3, line 8) and that if the copper is present at "unduly high concentrations, interference with the performance of the anti-wear additive may occur and a pronounced increase in wear may be observed on high stress points" (Col. 2, lines 50–53) of the engine. Although this patent contains one instance of use of copper at a concentration above 500 ppm (i.e., at 1200 ppm) no special mention is made of the effects of such higher concentration although FIG. 1 shows that the use of 1200 ppm copper gives a degree of cam and lifter wear which is lower than the maximum level shown in FIG. 1 (although still relatively high) with roughly the same degree of oxidation stability as measured by viscosity increase in the fluid at sixty-four hours.

The Colclough patent, in graphically representing the oxidation performance of varying levels of copper additive in its FIG. 1 shows that the presence of increasing levels of copper from about slightly above 200 ppm and above does not vary to any significant degree the oxidation performance of the lubricant containing this additive. In other words, this would teach the person of ordinary skill in the art that levels of copper in such a range do not positively effect the primary oxidation phenomena in which the lubricant is degraded to primary oxidation products which can then polymerize to higher molecular weight secondary products which yield undesired deposits. The Colclough concern, as reflected in the viscosity data plotted in FIGS. 2 and 3, is with inhibition of this secondary oxidation phenomenon of polymerization and not with the primary oxidation phenomenon.

SUMMARY OF THE INVENTION

It has been unexpectedly found that the use of higher levels of copper than suggested for use in the aforementioned patent unexpectedly is effective against both primary oxidation of the lubricant (e.g., as manifested by a loss of liquidity in the lubricant) as well as secondary reactions which form high molecular weight products leading to viscosity increase and ultimate deposit formation.

DETAILED DESCRIPTION OF THE INVENTION

The present invention is useful in improving the oxidation stability of a variety of formulated lubricants and is effective in lowering the level of deposit formation caused by the formation of high molecular weight products from the oxidation process while maintaining the liquidity of the lubricant (e.g., retarding the oxidative degradation and resulting evaporation of the lubricant).

The lubricants of this invention may be based on either mineral oil or synthetic basestocks or compatible mixtures of each. Representative synthetic basestocks include the synthetic hydrocarbon, polyol esters, and trimellitates, or combinations thereof which are known in the art.

The lubricants may contain other ingredients or adjuvants including alkyl zinc dithiophosphates, aryl zinc dithiophosphates, alkylaryl zinc dithiophosphates, metal-containing detergents, overbased detergents, dispersants, rust inhibitors, Mannich bases, phenol and amine-type oxidation inhibitors, corrosion inhibitors, antifoam additives, pour point depressants, viscosity index improvers that are conventionally used in the art.

The source for copper in the lubricants of the present invention can be any of the oil soluble copper compounds described in U.S. Pat. No. 4,867,890 including the copper salts of a synthetic or natural carboxylic acid such as the $C_{10}$ to $C_{18}$ fatty acids, unsaturated acids, such as oleic, or branched carboxylic acids such as naphthenic acids of molecular weight of from 200 to 500. Oil soluble copper dithiocarbamates, sulfonates, phenates or acetyl acetonates can also be used.

The amount of soluble copper used herein is preferably generally in the range of from about 1,500 to about 3,000, most preferably about 2,000. This is greater than the amounts advocated by U.S. Pat. No. 4,867,890.

The present invention is further illustrated by the Examples which follow.

EXPERIMENTAL PROCEDURE

The lubricants described below were tested using the Penn State microoxidation test which is described in Ind. Eng. Chem. Prod. Res. Dev. 1984, 23, 613–619 and Ind. Eng. Chem. Prod. Res. Dev. 1986, 25, 596–603.

The test system used consisted of two parts: (1) a glass tube with a flat bottom on which a metal cup that holds the lubricant was placed and (2) a removable glass cover with gas inlet and outlet tubes that directed the gas flow over the top of the thin fluid film. The microreactor was designed for a liquid charge of 10–100 μL (0.05–0.5 mm film thickness) so that oxygen diffusion problems were minimized or eliminated.

The reactor was immersed in a constant-temperature bath and its temperature was stabilized by circulating nitrogen at 20 mL/min for thirty minutes. Dry air was then circulated through the reactor at 20 mL/min for ten more minutes. At this point, the oil sample was injected onto the metal cup. Air flow was continued at 20 mL/min throughout the test period.

At the end of the chosen test time, the air flow was stopped, and the reactor was immediately removed from the hot bath and cooled rapidly in a high velocity stream of cold air. The liquid oxidation products on the metal cup were then diluted with appropriate solvents prior to spectrographic analysis.

The liquid products remaining on the cup after the reaction were diluted with tetrahydrofuran (THF). Exclusion chromatography or gel permeation chromatography (GPC) was then used to provide information on the molecular weight distribution of the products of the oxidation process. The amount of products which were insoluble in THF were determined by the weight increase of the test cup after it had been washed with THF. The THF solution of the liquid products was then separated into two equal parts. One part was analyzed directly by GPC to produce fractions which were in a lower molecular weight range, the same molecular weight range and a higher molecular weight range than the original lubricant. The second part of the THF solution was converted to a hexane solution by evaporating the THF and adding hexane. The hexane solution was percolated through a chromatographic column to remove the oxidized components leaving only the unreacted molecules from the mineral oil in hexane solution. The hexane was removed by distillation and the unreacted hydrocarbon from the mineral oil charge were evaluated in the GPC. This analysis showed only the unreacted hydrocarbons in the mineral oil.

EXAMPLE 1

A series of lubricant compositions were tested using the Penn State microoxidation test (20 μL liquid charge) on low carbon steel. Lubricant A consisted of 100% triisodecyl trimellitate. Lubricant B was 100% tertiary butylphenyl diphenyl phosphate, available as SYN-O-AD 8478 from Akzo Chemicals Inc. The Table given below sets forth the weight percent deposit for the test conducted at 250° C. with the values in parenthesis, where given, indicating the weight percent of liquid lubricant left in the catalyst cup.

| | Time (Min) | Deposit (Wt %) | Liquid Left (Wt %) |
|---|---|---|---|
| Lubricant A: | 40 | 4.6 | — |
| | 60 | 14.6 | — |
| | 120 | 17.8 | 10.4 |
| | 180 | 19.6 | 0.3 |
| Lubricant B: | 40 | 0.0 | — |
| | 60 | 0.0 | — |
| | 120 | 0.6 | — |
| Lubricant A + 2,000 ppm Cu: | 40 | 1.7 | — |
| | 60 | 1.8 | — |
| | 120 | 1.9 | 82.1 |
| | 180 | 4.2 | 71.6 |
| Lubricant A + 5% Lubricant B + 2,000 ppm Cu: | 120 | 0.5 | 75.1 |
| | 180 | 4.2 | 68.4 |

EXAMPLE 2

Another lubricant was tested in this run using the same procedure described for Example 1.

Lubricant C was a mixture of 82.58 wt. % of Lubricant A, 5.0% of Lubricant B, and 12.42% of a diesel crankcase additive package supplied by Lubrizol (LUBRIZOL OSH 85137).

| | Time (Min) | Deposit (Wt %) | Liquid Left (Wt %) |
|---|---|---|---|
| Lubricant C: | 60 | 4.8 | — |
| | 120 | 10.5 | — |
| | 180 | 13.8 | 13.5 |
| Lubricant C + 2,000 ppm Cu: | 60 | 0.2 | — |
| | 120 | 2.6 | — |
| | 180 | 10.3 | 61.6 |

EXAMPLE 3

Another lubricant was tested as tested in Examples 1 and 2.

Lubricant D contained the following ingredients:

| Ingredient | Wt % |
|---|---|
| Triisodecyl trimellitate | 83.73 |
| t-butylphenyl diphenyl phosphate (SYN-O-AD 8478) | 5 |
| Diisodecyl phthalate (HATCOL 2933) | 5 |
| Octylated N-phenyl-1-naphthylamine (IRGANOX L06) | 0.75 |
| p,p'-dioctyldiphenylamine | 0.75 |
| Calcium alkyl phenate | 1.0 |
| Zinc diaryldithiophosphate | 0.75 |
| Succinimide | 3 |
| Benzotriazole | 0.02 |

| | Time (Min) | Deposit (Wt %) | Liquid Left (Wt %) |
|---|---|---|---|
| Lubricant D: | 60 | 0.5 | — |
| | 80 | 1.9 | — |
| | 120 | 5.3 | — |
| | 180 | 12.8 | 9.5 |
| Lubricant D + 2,000 ppm Cu: | 60 | 0.2 | — |
| | 80 | 0.0 | — |
| | 120 | 0.0 | — |
| | 180 | 2.4 | 67.9 |

EXAMPLE 4

Two additional lubricants were tested on low carbon steel using the microoxidation test of Examples 1–3.

Lubricant E comprised the following ingredients:

| Ingredient | Wt % |
|---|---|
| Ditridecyl dodecandioate (HATCOL 2907) | 60.08 |
| Polymer ester* (KETJENLUBE 135) | 28.00 |
| Diesel crankcase additive (PARANOX 255) | 10.06 |
| Overbased calcium phenate (OLOA 246B) | 0.70 |
| Long chain alkaryl polyether (OLOA 249) | 0.1 |
| Phenyl-α-naphthylamine | 0.5 |
| Benzotriazole | 0.02 |

*Butanol ester of an α-olefin dicarboxylic acid copolymer with a molecular weight of about 1800 and a nominal viscosity of 35 $mm^2/s$ at 100° C.

Lubricant F was the same as Lubricant E except that the polymer ester was used at 42.28 wt. % and trimethylol propane trinonoate was used at 45.86% in place of ditridecyl dodecandioate.

The first test was conducted at 225° C. with the following results:

| | Time (Min) | Deposit (Wt %) | Liquid Left (Wt %) |
|---|---|---|---|
| Lubricant E | 120 | 38.0 | 7.9 |
| Lubricant E + 2,000 ppm Cu | 120 | 0.3 | 86.0 |
| Lubricant F | 120 | 36.6 | 17.7 |
| Lubricant F + 2,000 ppm Cu | 120 | 0.3 | 83.4 |

The second test was conducted at 250° C. with the following results:

| | Time (Min) | Deposit (Wt %) | Liquid Left (Wt %) |
|---|---|---|---|
| Lubricant E | 60 | 35.2 | 7.4 |
| Lubricant E + 2,000 | 60 | 0.6 | 75.2 |

-continued

| | Time (Min) | Deposit (Wt %) | Liquid Left (Wt %) |
|---|---|---|---|
| ppm Cu | | | |
| Lubricant F | 60 | 35.8* | 9.9* |
| Lubricant F + 2,000 ppm Cu | 60 | 0.7 | 64.8 |
| Lubricant E | 120 | 34.2 | 0 |
| Lubricant E + 2,000 ppm Cu | 120 | 6.6 | 56.6 |
| Lubricant F | 120 | 34.8 | 0 |
| Lubricant F + 2,000 ppm Cu | 120 | 10.5 | 36.4 |

*a repeat run gave values of 36.7 and 8.1, respectively.

EXAMPLE 5

The Table set forth below shows the effect of various levels of dissolved copper on the stability of a white mineral oil in the Penn State microoxidation test at 225° C. on a low carbon steel surface (30 minutes in air). The white mineral oil had an average molecular weight of 430, a boiling point of 360°–530° C. a specific gravity of 0.88 (60/60° C.), an ASTM Slope of 0.759, and viscosities of 75.9 cst (40° C.) and 8.2 cst (100° C.).

All values given below are in weight percent.

| Cu Added (ppm) | Unreacted Fluid | Deposit Formation | Evaporation of Fluid |
|---|---|---|---|
| 0 | 29 | 6 | 29 |
| 200 | 24 | 2 | 11 |
| 1,000 | 57 | 1 | 23 |
| 2,000 | 66 | 0 | 9 |

| Cu Added (ppm) | OXLMW* | OXSMW** | OXHMW*** |
|---|---|---|---|
| 0 | 0 | 22 | 26 |
| 200 | 0 | 50 | 13 |
| 1,000 | 0 | 17 | 2 |
| 2,000 | 0 | 25 | 0 |

*oxidized material of lower molecular weight than the white mineral oil.
**oxidized material of the same molecular weight than the white mineral oil.
***oxidized material of higher molecular weight than the white mineral oil.

The addition of a relatively small amount of copper salt (200 ppm), such as advocated by the Colclough patent, increases the rate of oxidation (as reflected by the decreased level of unreacted fluid) but decreases the secondary reaction in which primary oxidation products form higher molecular weight polymers. At intermediate copper concentrations (1,000 ppm) the presence of copper shows an unexpected inhibiting influence on the primary oxidation reaction (as reflected by the increased level of unreacted fluid as compared to a control fluid containing no copper) and further decreases the rate of the condensation-polymerization process. Raising the copper concentration (2,000 ppm) gives a further improvement in reducing both primary oxidation and secondary reactions to form high molecular weight products.

The amount of fluid evaporation is initially retarded at low copper levels (200 ppm) but increases when the copper level is increased (to 1,000 ppm) before decreasing again at higher copper levels (2,000 ppm).

EXAMPLE 6

The Table set forth below gives the iron concentration, which is known to catalyze both primary oxidation and secondary condensation-polymerization reactions, in the oxidized oil from Example 5:

| Cu Added (ppm) | Iron Content (ppm) |
|---|---|
| 0 | 900 |
| 200 | 100 |
| 1,000 | Below detectible limits |
| 2,000 | Below detectible limits |

Addition of copper at levels of 1,000 ppm and above reduced the iron content in the fluid to below detectible limits.

EXAMPLE 7

This Example illustrates the effect of dissolved copper salts on the stability of a poly-α-olefin (PAO) lubricant and a trimethylolpropane triheptanoate (TMPTH) lubricant when the testing was done for thirty minutes at 225° C. in the Penn State microoxidation test with air on low carbon steel surfaces.

The PAO lubricant had viscosities of 31.0 cst (40° C.) and 6.0 cst (100° C.), an ASTM Slope of 0.668, a specific gravity of 0.83 (60/60° C.), an average molecular weight of 529, and a boiling point of 420°–520° C.

The TMPTH lubricant had viscosities of 14.8 cst (40° C.) and 3.4 cst (100° C.), an ASTM Slope of 0.741, a specific gravity of 0.96 (60/60° C.), an average molecular weight of 470, and a boiling point of 443° C.

| Lubricant + Cu | OXLMW | SMW* | OXHMW | Deposit | Evap. |
|---|---|---|---|---|---|
| PAO + 0 | 4 | 71 | 6 | 1 | 19 |
| PAO + 2,000 ppm | 3 | 91 | 1 | 0 | 5 |
| TMPTH + 0 | 0 | 34 | 15 | 2 | 49 |
| TMPTH + 2,000 | 1 | 87 | 2 | 1 | 9 |

*Clay percolation was used to separate the unreacted hydrocarbon from the oxidized products of the mineral oil. The procedure could not be used in the same manner for the synthetics. Therefore, the same molecular weight fraction in this Table may contain some primary oxidation product.

COMPARATIVE EXAMPLE 8

This Example shows the effect of dissolved copper salts for the same lubricant system shown in Example 5 with the exception that a glass surface was used rather than the low carbon steel surface employed in Example 5.

| Cu Added (ppm) | Unreacted Fluid | Deposit Formation | Evaporation of Fluid |
|---|---|---|---|
| 0 | 34 | 0 | 15 |
| 200 | 27 | 0 | 13 |
| 1,000 | 69 | 0 | 4 |
| 2,000 | 80 | 0 | 7 |

| Cu Added (ppm) | OXLMW* | OXSMW** | OXHMW** |
|---|---|---|---|
| 0 | 0 | 48 | 3 |
| 200 | 0 | 52 | 8 |
| 1,000 | 4 | 23 | 0 |
| 2,000 | 1 | 11 | 1 |

*oxidized material of lower molecular weight than the white mineral oil.
**oxidized material of the same molecular weight than the white mineral oil.
***oxidized material of higher molecular weight than the white mineral oil.

A comparison of the data from this Example with that from Example 5 indicates that the rate of oxidation on the low carbon steel surface used in Example 5 was only slightly higher than the rate realized with a glass surface (29% unreacted after thirty minutes versus 34%). The most dramatic effect of the low carbon steel surface is on the rate of the condensation polymerization. After thirty minutes at 225° C. in the presence of an inert glass surface, only 3% of the mineral oil was converted to high molecular weight oxidation products and no insoluble deposits were detected. In contrast, in the presence of the low carbon steel surface, 26% of the mineral oil was converted to high molecular weight products which are soluble in tetrahydrofuran and 6% of the original lubricant had ended up as insoluble deposits.

The foregoing Examples are presented for illustrative purposes only and should not be construed in a limiting sense for that reason. The scope of protection sought is set forth in the claims which follow.

We claim:

1. A method of reducing the level of oxidation of a lubricant, comprising a basestock, while being used in an internal combustion engine, which comprises incorporating soluble copper in the lubricant, in an amount above 1,200 ppm, which is effective in reducing deposit formation in the engine and in retarding primary oxidation of the lubricant while the lubricant is being used in the engine.

2. A method of reducing the level of oxidation of a lubricant, comprising a basestock, while being used in an internal combustion engine which comprises incorporating soluble copper in the lubricant in an amount of from about 1,500 to about 3,000 ppm which is effective in reducing deposit formation in the engine and in retarding primary oxidation of the lubricant while the lubricant is being used in the engine.

3. A method as claimed in claim 1 wherein the copper is present at about 2,000 ppm.

4. A method of reducing the level of oxidation of a lubricant, comprising a basestock, while being used in an internal combustion engine which comprises incorporating soluble copper in the lubricant, which copper is derived from an oil soluble copper compound, in an amount of from about 1,500 to about 3,000 ppm which is effective in reducing deposit formation in the engine and in retarding primary oxidation of the lubricant while the lubricant is being used in the engine.

5. A method as claimed in claim 4 wherein the copper is present at about 2,000 ppm.

* * * * *